US011358071B1

(12) United States Patent
Bagley

(10) Patent No.: US 11,358,071 B1
(45) Date of Patent: Jun. 14, 2022

(54) BUILDING BLOCK TOY

(71) Applicant: Gracewood Management, Inc., West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 0 days.

(21) Appl. No.: 17/138,451

(22) Filed: Dec. 30, 2020

(51) Int. Cl.
*A63H 33/06* (2006.01)
*A63H 33/08* (2006.01)

(52) U.S. Cl.
CPC ..... *A63H 33/086* (2013.01); *A63H 33/062* (2013.01)

(58) Field of Classification Search
CPC ..... A63H 33/086; A63H 33/04; A63H 33/062
USPC ..... 446/115
See application file for complete search history.

(56) References Cited

U.S. PATENT DOCUMENTS 2,057,942 A * 10/1936 Fay ..... A63H 33/108 446/112
2,776,521 A * 1/1957 Zimmerman ..... A63H 33/065 446/115
4,055,019 A * 10/1977 Harvey ..... A63F 9/12 446/115
4,214,403 A 7/1980 Knudsen
4,253,268 A * 3/1981 Mayr ..... A63H 33/042 16/224
4,355,781 A * 10/1982 Stolpin ..... A63H 33/04 249/184
4,685,892 A 8/1987 Gould et al.
4,731,041 A * 3/1988 Ziegler ..... A63H 33/065 446/115
4,792,319 A 12/1988 Svagerko
4,874,341 A * 10/1989 Ziegler ..... A63H 33/08 446/109
4,918,786 A 4/1990 Perry
5,009,625 A 4/1991 Longuet-Higgins
5,100,358 A 3/1992 Volgger
5,100,359 A 3/1992 Gorio
(Continued)

FOREIGN PATENT DOCUMENTS

CA 1304578 C 7/1992
CA 2258415 A1 7/2000
(Continued)

OTHER PUBLICATIONS

Chen et al., Machine Translation of CN213100839U, uploaded Aug. 16, 2021, Espacenet, 7 pages.*

*Primary Examiner* — Eugene L Kim
*Assistant Examiner* — Matthew B Stanczak
(74) *Attorney, Agent, or Firm* — Barnes & Thornburg LLP; Ryan L. Marshall; Jessica Kiser

(57) ABSTRACT

An interlocking toy set comprising a plurality of interlocking pieces is disclosed herein. The interlocking pieces include a planar body having a top side, a bottom side opposite the top side, and a plurality of lateral edges that extend between and interconnect the top and bottom sides. The interlocking pieces also include a plurality of interlocking flanges that extend away from each lateral edge and configured to interlock with corresponding interlocking flanges formed on a lateral edge of an adjacent interlocking piece.

19 Claims, 7 Drawing Sheets

(56) References Cited

U.S. PATENT DOCUMENTS 5,183,430 A * 2/1993 Swann ..... A63H 33/04 446/104
5,456,555 A 10/1995 Bokeler
5,501,626 A * 3/1996 Harvey ..... A63H 33/04 446/104
D409,668 S * 5/1999 Madner ..... D21/484
6,116,980 A * 9/2000 Bauer ..... A63H 33/04 446/104
6,142,848 A * 11/2000 Madner ..... A63H 33/04 446/107
6,176,757 B1 1/2001 Lin
6,186,855 B1 * 2/2001 Bauer ..... A63H 33/04 446/104
6,925,770 B2 * 8/2005 Sorensen ..... A63H 33/062 403/119
6,948,998 B2 9/2005 Bagley
7,438,623 B2 * 10/2008 Lin ..... A63H 33/086 446/104
7,648,407 B1 * 1/2010 Sorensen ..... A63H 33/084 446/120
7,749,042 B2 * 7/2010 Fulgenzi ..... A63H 33/062 446/108
D645,912 S * 9/2011 Hardstaff ..... D21/502
8,197,922 B2 * 6/2012 Bromley ..... B29C 65/58 428/53
8,529,311 B2 9/2013 Tremblay et al.
9,498,735 B2 * 11/2016 Mohanty ..... G09B 23/00
9,522,342 B2 * 12/2016 Jazouli ..... A63H 33/086
9,643,101 B2 * 5/2017 Acerra ..... A63H 33/084
9,669,324 B2 6/2017 Roth et al.
10,159,905 B2 12/2018 Bagley
10,188,960 B2 1/2019 Berglund et al.
10,612,721 B2 4/2020 Katz
2004/0216271 A1 11/2004 Schott
2006/0145418 A1 * 7/2006 Plein ..... A63F 9/1288 273/155
2007/0051055 A1 * 3/2007 Lin ..... A63H 33/086 52/81.1
2009/0130947 A1 * 5/2009 Fulgenzi ..... A63H 33/086 446/105
2010/0130094 A1 5/2010 Michalk et al.
2010/0330867 A1 12/2010 Fogel et al.
2014/0270934 A1 * 9/2014 Acerra ..... A63H 33/108 403/364
2015/0260206 A1 * 9/2015 Acerra ..... A63H 33/105 403/364
2016/0114255 A1 * 4/2016 Jazouli ..... A63H 33/086 446/104
2017/0340981 A1 * 11/2017 Iliovits ..... A63H 33/086
2018/0056207 A1 * 3/2018 Bagley ..... A63H 33/086
2018/0099232 A1 * 4/2018 Choi ..... A63H 33/044
2019/0321741 A1 * 10/2019 Park ..... A63H 33/067

FOREIGN PATENT DOCUMENTS

CN 213100839 U * 5/2021 ..... A63H 33/08
EP 357282 A1 3/1990
GB 2429934 A 3/2007

* cited by examiner

BUILDING BLOCK TOY

FIELD OF DISCLOSURE

The present disclosure relates generally to toys, and more specifically to building block toys.

BACKGROUND

This invention refers to construction or building block toys, and in particular, to interconnecting construction pieces.

Children have played with and learned from their play with building blocks for many years. Such building blocks include different types of connectable blocks, from rudimentary stackable wood blocks to interlocking or otherwise engaging block systems. In some embodiments, the building blocks have had hinged elements that allow adjacent blocks to move relative to each other and create different shapes. However, such building blocks, including building blocks with hinged connections, have limited interconnection options that provide little variation to the different shapes being constructed. For instance, the hinged connections may be limited to 45 degree angles between the hinged pieces. It is an object of the present invention to provide a set of interlocking pieces with varying shapes and a capability for a variety of interconnection options.

SUMMARY

The present disclosure may comprise one or more of the following features and combinations thereof.

An interlocking toy set may comprise a plurality of interlocking pieces. The plurality of interlocking pieces may comprise a planar body and a plurality of interlocking flanges.

In some embodiments, the planar body may include a top side, a bottom side opposite the top side, and a plurality of lateral edges. The plurality of lateral edges may extend between and interconnect the top and bottom sides. The plurality of interlocking flanges may extend away from each edge of the plurality of lateral edges.

In some embodiments, the plurality of interlocking flanges may be configured to interlock with corresponding interlocking flanges formed on a lateral edge of an adjacent interlocking piece of the plurality of interlocking pieces. The interlocked flanges may provide a snap-hinge connection that couples adjacent interlocking pieces together and allows the adjacent interlocking pieces to rotate relative to each other about an interlock pivot axis. The interlock pivot axis may be parallel to the lateral edge of the adjacent interlocking piece.

In some embodiments, the plurality of interlocking flanges may include a first interlocking flange, a second interlocking flange, and a third interlocking flange. The second interlocking flange may be spaced apart axially from the first interlocking flange relative to the interlock pivot axis to define a slot therebetween. The third interlocking flange may be spaced apart axially from the second interlocking flange relative to the interlock pivot axis. The third interlocking flange may be configured to extend into the slot formed between the first and second interlock flanges on the adjacent interlocking piece.

In some embodiments, the first interlocking flange may be shaped to include a first domed protrusion and a knob. The first domed protrusion may axially extend away from the first interlocking flange. The knob may axially extend away from the first interlocking flange opposite the first domed projection. In some embodiments, the knob may be configured to provide assistance in disassembling the adjacent interlocking pieces.

In some embodiments, the second interlocking flange may be shaped to include a second domed protrusion. The second domed protrusion may axially extend away from the second interlocking flange.

In some embodiments, the third interlocking flange may engage the first domed protrusion and the second domed protrusion to provide the snap-hinge connection therebetween. The snap-hinge connection may be configured to allow the adjacent interlocking pieces to form an acute angle between the planar body of one interlocking piece and the planar body of the adjacent interlocking piece. In some embodiments, the acute angle may be about 30 degrees.

In some embodiments, the plurality of lateral edges may include at least three lateral edges. In some embodiments, the plurality of lateral edges may include at least four lateral edges. In some embodiments, the plurality of lateral edges may include more than four lateral edges.

In some embodiments, the first interlocking flange may have a first thickness. The first thickness may be equal to a second thickness of the second interlocking flange. The first thickness may be greater than a third thickness of the third interlocking flange.

In some embodiments, the third interlocking flange may comprise a first side surface, a second side surface, a first depression, and a second depression. The second side surface may be spaced axially apart from the first side surface to define a thickness of the third interlocking flange. The first depression may extend into the first side surface and the second depression may extend into the second side surface.

In some embodiments, the first and second depressions may be configured to engage corresponding domed protrusions of the adjacent interlocking piece. The first and second depressions may engaged the corresponding domed protrusions of the adjacent interlocking piece to provide the snap-hinge connection therebetween.

In some embodiments, the first and second depressions may include a first portion and a second portion. The first portion may be located on the interlock pivot axis. The second portion may extend from the first portion to an edge of the third interlocking flange.

In some embodiments, the planar body may be shaped to include a hole. The hole may extend through the planar body from the top side to the bottom side at a center of the planar body.

In some embodiments, the hole may be shaped to include a plurality of lateral inner edges. The plurality of lateral inner edges may be equal to the number of plurality of lateral edges of the planar body.

In some embodiments, the hole may be shaped to include a plurality of lateral inner edges. The plurality of inner edges may be less than or greater than a number of lateral edges included in the plurality of lateral edges of the planar body.

According to another aspect of the present disclosure, an interlocking toy set may comprise a plurality of interlocking pieces. The plurality of interlocking pieces may comprise a planar body and a plurality of interlocking flanges.

In some embodiments, the planar body may include a plurality of lateral edges. The plurality of lateral edges may be of equal length. The plurality of lateral edges may be shaped to form a polygonal shape of the planar body.

In some embodiments, the plurality of interlocking flanges may extend away from each lateral edge of the plurality of lateral edges. The plurality of interlocking flanges may be configured to interlock with corresponding interlocking flanges formed on a lateral edge of an adjacent interlocking piece of the plurality of interlocking pieces.

In some embodiments, the interlocked flanges may provide a snap-hinge connection that couples adjacent interlocking pieces together and allows the adjacent interlocking pieces to rotate relative to each other about an interlock pivot axis. The interlock pivot axis may be parallel to the lateral edge of the adjacent interlocking piece.

In some embodiments, the plurality of interlocking flanges may include a first interlocking flange, a second interlocking flange, and a third interlocking flanges. The second interlocking flange may be spaced apart axially from the first interlocking flange relative to the interlock pivot axis to define a slot therebetween. The third interlocking flange may be spaced apart axially from the second interlocking flange relative to the interlock pivot axis.

In some embodiments, the first interlocking flange may be shaped to include a first domed protrusion. The first domed protrusion may axially extend away from the first interlocking flange.

In some embodiments, the second interlocking flange may be shaped to include a second domed protrusion. The second domed protrusion may axially extend away from the second interlocking flange.

In some embodiments, the third interlocking flange may be configured to extend into the slot formed between the first and second interlock flanges on the adjacent interlocking piece. The third interlocking flange may engage the first and second domed protrusions to provide the snap-hinge connection therebetween, In some embodiments, the snap-hinge connection may be configured to allow the adjacent interlocking piece to form an acute angle therebetween. The acute angle may be about 30 degrees.

In some embodiments, the plurality of lateral edges may include at least three lateral edges. In some embodiments, the first interlocking flange may have a first thickness equal to a second thickness of the second interlocking flange and greater than a third thickness of the third interlocking flange.

In some embodiments, each third interlocking flange may comprise a first side surface, a second side surface, a first depression, and a second depression. The second side surface may be spaced axially apart from the first side surface to define a thickness of the third interlocking flange.

In some embodiments, a first depression may extend into the first side surface and the second depression may extend into the second side surface. The first and second depressions may be configured to engage corresponding domed protrusions of the adjacent interlocking piece to provide the snap-hinge connection therebetween.

In some embodiments, the first interlocking flange may be shaped to include a knob. The knob may axially extend away from the first interlocking flange opposite the domed projection included in the first interlocking flange.

In some embodiments, the planar body may be shaped to include a hole. The hole may extend through the planar body at a center of the planar body.

These and other features of the present disclosure will become more apparent from the following description of the illustrative embodiments.

DETAILED DESCRIPTION OF THE DRAWINGS

Figure 1:
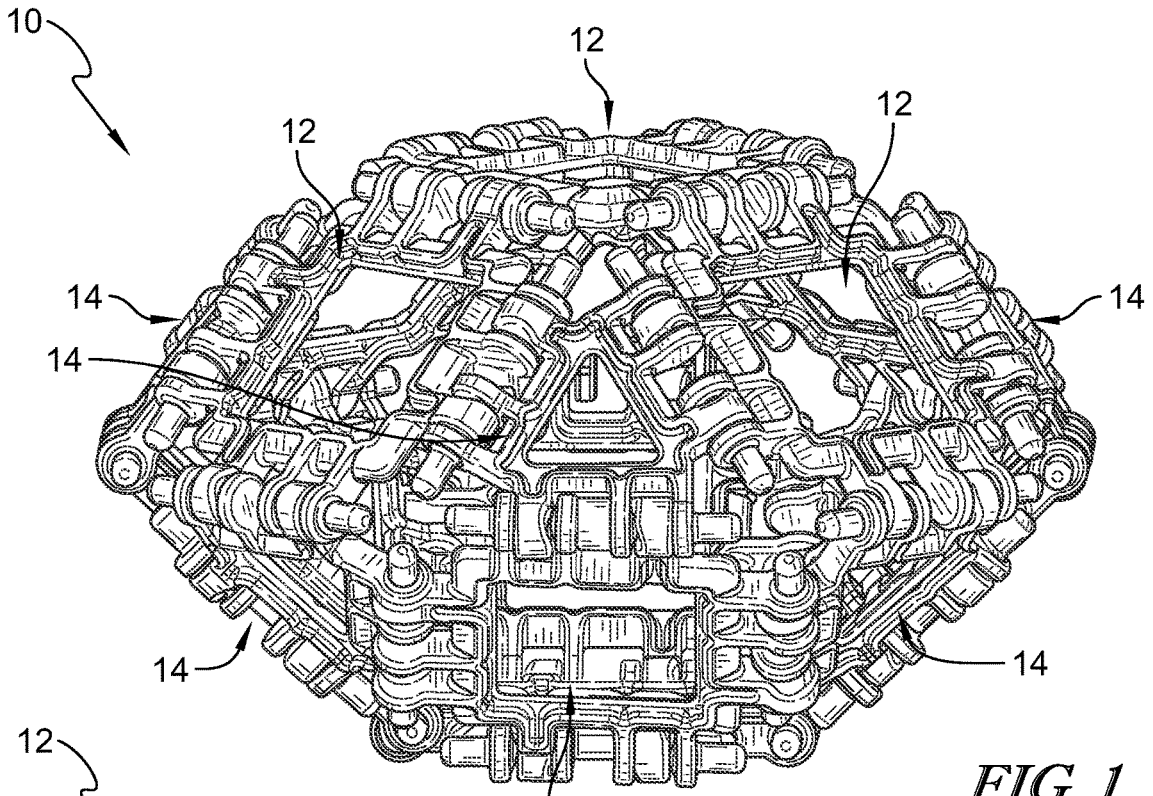
FIG. 1 is a perspective view of an interlocking toy set comprising a plurality of interlocking pieces of different shapes that are each configured to interlock with each other to form intricate shapes and objects.

For the purposes of promoting an understanding of the principles of the disclosure, reference will now be made to a number of illustrative embodiments illustrated in the drawings and specific language will be used to describe the same.

An illustrative interlocking toy set 10 is shown in FIG. 1, which includes a plurality of interlocking pieces 12, 14. The plurality of interlocking pieces 12, 14 have different polygonal shapes, and in particular the plurality of interlocking pieces 12, 14 include square shaped pieces 12 or triangular shaped pieces 14 in the illustrative embodiments. The plurality of interlocking pieces 12, 14 may include additional interlocking pieces 12, 14 with different polygonal shapes.

Each of the square interlocking pieces 12 included in the plurality of interlocking pieces 12, 10 includes a planar body 16 and a plurality of interlocking flanges 18, 20, 22, 24 as shown in FIGS. 1-4. The planar body 16 has a top side 26, a bottom side 28 opposite the top side 26, and a plurality of lateral edges 30, 32, 34, 36. The plurality of lateral edges 30, 32, 34, 36 extend between and interconnect the top and bottom sides 26, 28. For the different polygonal shapes, the number of lateral edges vary depending on the shape of the planar body. The plurality of interlocking flanges 18, 20, 22, 24 extend away from each lateral edge 30, 32, 34, 36 of the plurality of lateral edges 30, 32, 34, 36 and are configured to interlock with corresponding interlocking flanges 18', 20', 22', 24' formed on a lateral edge 30', 32', 34', 36' of an adjacent interlocking piece 12'.

The adjacent interlocking pieces 12' are identical to the interlocking pieces 12. The description of the interlocking pieces 12 is incorporated by reference to apply to the adjacent interlocking pieces 12'.

Figure 5:
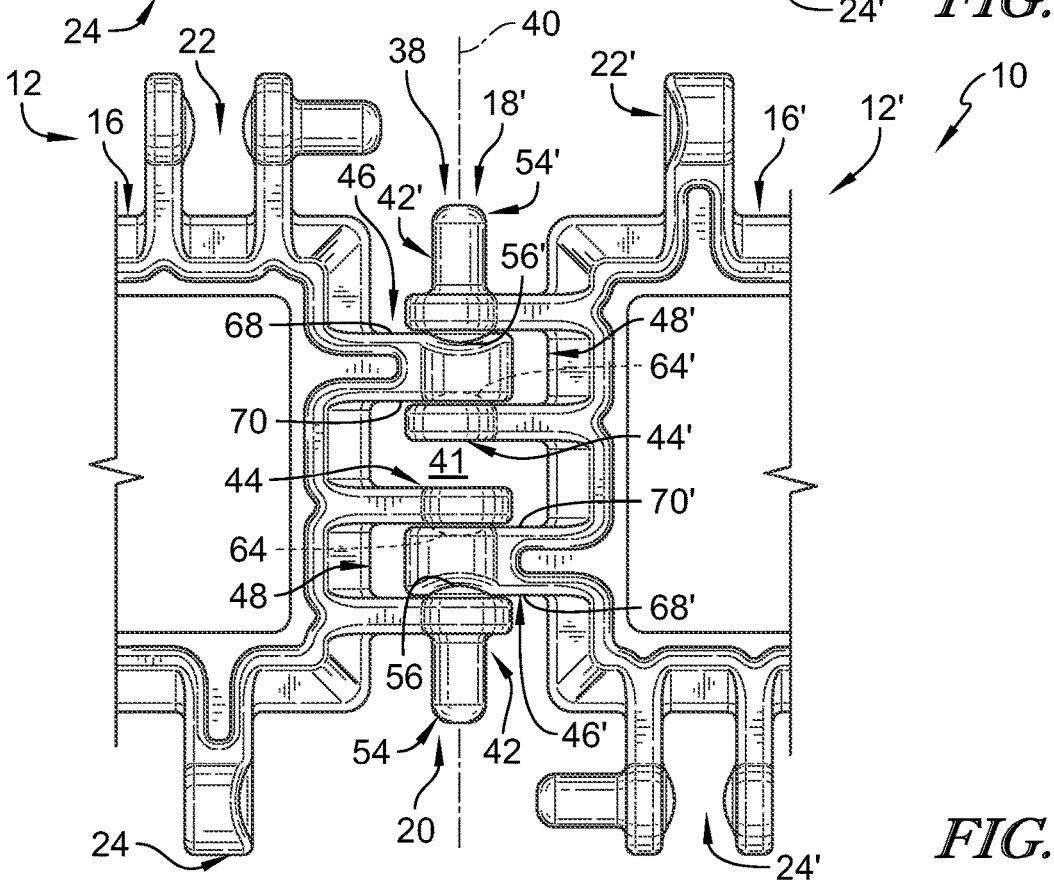
FIG. 5 is a view similar to FIG. 4 showing the adjacent interlocking pieces with the interlocking flanges engaged in the snap-hinge connection with each third interlocking flange located in the slot so that the domed protrusions of each adjacent interlocking piece are engaged with the corresponding depressions on the third interlocking flange.
Figure 6:
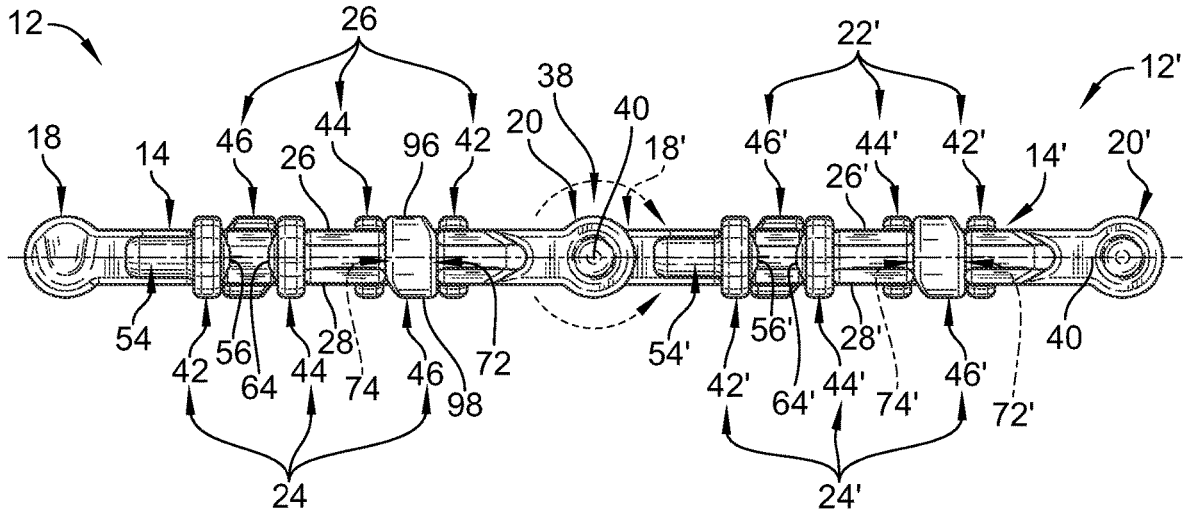
FIG. 6 is an elevation view of the adjacent interlocking pieces of FIG. 5 showing the adjacent interlocking pieces with the interlocking flanges engaged in the snap-hinge connection.
Figure 7:
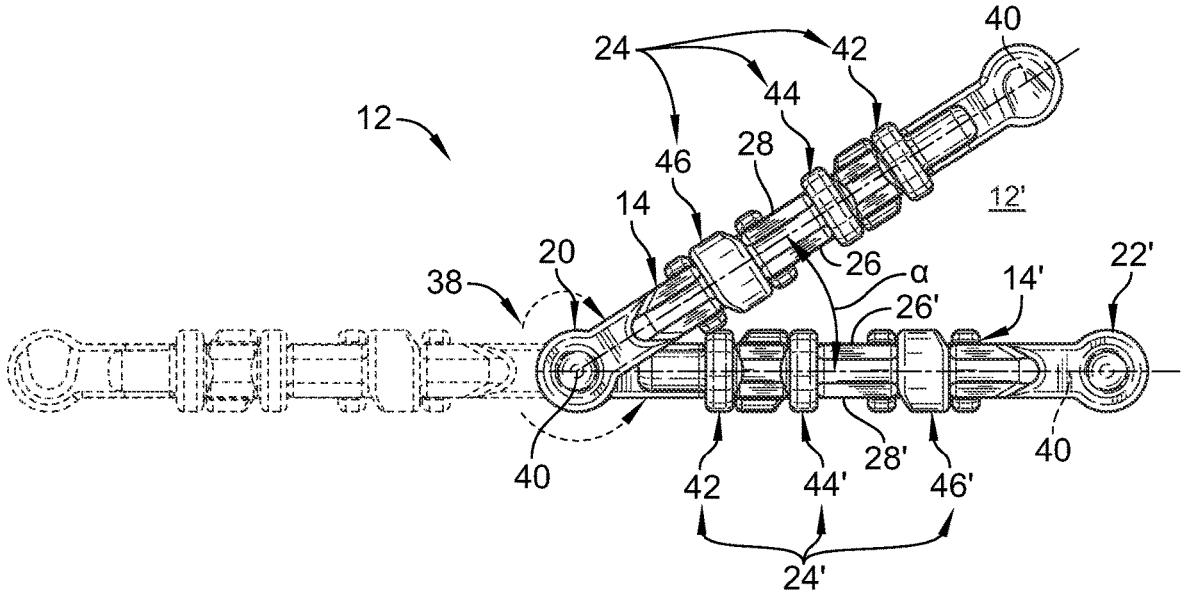
FIG. 7 is a view similar to FIG. 6 showing the adjacent pieces may form acute angles therebetween.

The plurality of interlocking flanges 18, 20, 22, 24 of one interlocking piece 12 interlock with interlocking flanges 18', 20', 22', 24' of an adjacent interlocking piece 12' to provide a snap-hinge connection 38 as shown in FIGS. 5-7. The snap-hinge connection 38 couples the adjacent interlocking pieces 12, 12' together and allows the adjacent interlocking pieces 12, 12' to rotate relative to each other about an interlock pivot axis 40. The interlock pivot axis 40 is parallel to the lateral edges 30, 32, 34, 36, 30', 32', 34', 36' of the adjacent interlocking pieces 12, 12'.

Unlike other hinged toy pieces, the snap-hinge connection 38 is configured to allow the adjacent interlocking pieces 12, 12' to form an acute angle $\alpha$ between the planar body 16 of one interlocking piece 12 and the planar body 16' of the adjacent interlocking piece 12' as shown in FIG. 7. The acute angle $\alpha$ may be about 30 degrees in some embodiments. In other embodiments, the acute angle $\alpha$ may be between about 30 degrees and 40 degrees.

The plurality of lateral edges 30, 32, 34, 36 includes at least four lateral edges 30, 32, 34, 36 in the illustrative embodiment. The first lateral edge 30 is spaced laterally apart from the second lateral edge 32 and is parallel to the second lateral edge 32. The third lateral edge 34 and the fourth lateral edge 36 extend between and interconnect the first and second lateral edges 30, 32 and are parallel to each other. In some embodiments, the plurality of lateral edges 30, 32, 34, 36 include more than four lateral edges. In other embodiments, the plurality of lateral edges 30, 32, 34, 36 may include a different number of lateral edges, for example 5, 6, 7, 8, 9, or 10.

In the illustrative embodiment, the plurality of interlocking flanges 18, 20, 22, 24 on each lateral edge 30, 32, 34, 36 of the planar body 16 includes a first interlocking flange 42, a second interlocking flange 44, and a third interlocking flange 46 as shown in FIGS. 2-7. The second interlocking flange 44 is spaced apart axially from the first interlocking flange 42 relative to the interlock pivot axis 40 to define a slot 48 therebetween. The third interlocking flange 46 is spaced apart axially from the second interlocking flange 44 relative to the interlock pivot axis 40.

The third interlocking flange 46 is configured to extend into the slot 48' formed between the first and second interlock flanges 42', 44' on the adjacent interlocking piece 12' as shown in FIGS. 2-7. The third interlocking flange 46 engages the first and second interlock flanges 42', 44' to provide the snap-hinge connection 38 therebetween.

Each of the first interlocking flanges 42 and the second interlocking flanges 44 are shaped to include a domed protrusion 56, 64 as shown in FIGS. 2-7. The first domed protrusion 64 on the first interlocking flange 42 extends away from the first interlocking flange 42 into the slot 48, while the second domed protrusion 64 on the second interlocking flange 44 extends away from the second interlocking flange 44 into the slot 48. The first and second domed protrusions 56, 64 are configured to engage the third interlocking flange 46' of the adjacent interlocking piece 12' to provide the snap-hinge connection 38 therebetween.

Figure 3:
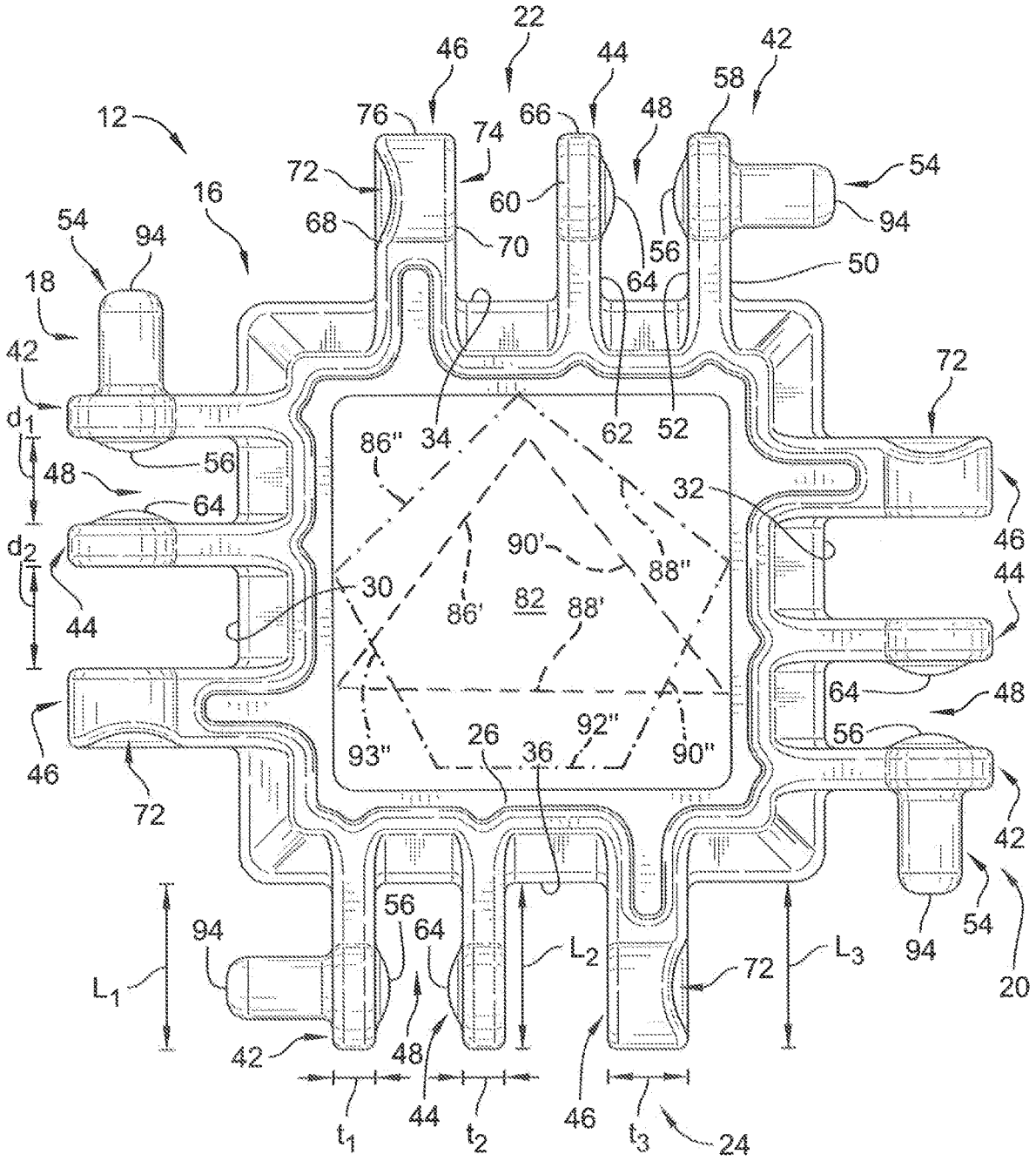
FIG. 3 is an elevation view of the interlocking piece of FIG. 2 showing the plurality of interlocking flanges on each lateral edge of the planar body includes a first interlocking flange, a second interlocking flange spaced apart axially from the first interlocking flange relative to an interlock pivot axis to define a slot therebetween, and a third interlocking flange spaced apart axially from the second interlocking flange relative to the interlock pivot axis.
Figure 4:
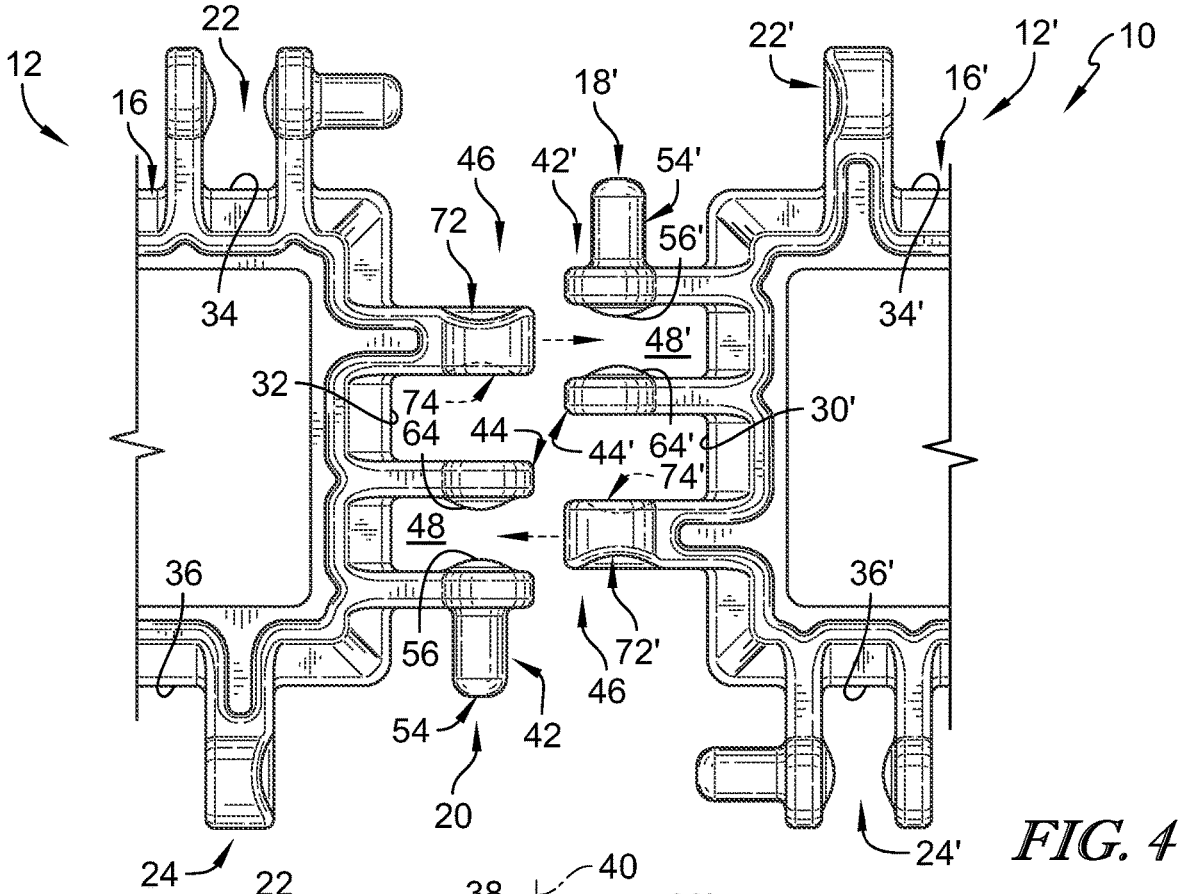
FIG. 4 is a detail elevation view of adjacent interlocking pieces included in the plurality of interlocking pieces of FIG. 1 showing each of the first and second interlocking flanges are shaped to include a domed protrusion that extends away from one of the first or second interlocking flanges into the slot, while each third interlocking flange is shaped to include one or more depressions that are each configured to receive one of the domed protrusions of the first and second interlocking flanges to provide the snap-hinge connection.

The first interlocking flange 42 comprises a first side surface 50, a second side surface 52, a knob 54, and the first domed protrusion 56 as shown in FIG. 3. The first and second side surfaces 50, 52 extend away from the corresponding lateral edge 30, 32, 34, 36 to a terminal end 58. The second side surface 52 is spaced axially apart from the first side surface 50 to define a first thickness $t_1$ of the first interlocking flange 42. The knob 54 extends from the first side surface 50 along the interlock pivot axis 40. The second side surface 52 faces the slot 48 such that the first domed protrusion 56 extends from the second side surface 52 into the slot 48.

The knob 54 is configured to provide a grip for a user to aid in dis-engaging the snap-hinge connection 38, while also providing a visual indicator as to the correct alignment of the interlocking flanges 42, 44, 46. The In the illustrative embodiment, the knob 54 extends to a terminal end 94 that is flush with the perpendicular lateral edge 30, 32, 34, 36. In this way, the knob 54 is short enough so as to not interfere with adjacent interlocking pieces 12' when assembling different shapes and objects.

In the illustrative embodiment, the second interlocking flange 44 comprises a first side surface 60, a second side surface 62, and the second domed protrusion 64 as shown in FIG. 3. The first and second side surfaces 60, 62 extend away from the corresponding lateral edge 30, 32, 34, 36 to a terminal end 66. The second side surface 62 is spaced axially apart from the first side surface 60 to define a second thickness $t_2$ of the second interlocking flange 44. The second side surface 62 faces the slot 48 such that the second domed protrusion 64 extends from the second side surface 62 into the slot 48.

Each third interlocking flange 46 comprises a first side surface 68, a second side surface 70, and depressions 72, 74 as shown in FIG. 3. The first and second side surfaces 68, 70 extend away from the corresponding lateral edge 30, 32, 34, 36 to a terminal end 76. The second side surface 70 is spaced axially apart from the first side surface 68 to define a third thickness t3 of the third interlocking flange 46. The first depression 72 extends into the first side surface 68, while the second depression 74 extends into the second side surface 70. The first and second depressions 72, 74 are configured to engage corresponding domed protrusions 56', 64' of the adjacent interlocking piece 12' to provide the snap-hinge connection 38 therebetween.

In the illustrative embodiment, the first thickness $t_1$ of the first interlocking flange 42 and the second thickness $t_2$ of the second interlocking flange 44 are equal. The third thickness t3 of the third interlocking flange 46 is greater than the first and second thicknesses $t_1$, $t_2$ of the first and second interlocking flanges 42, 44.

Figure 2:
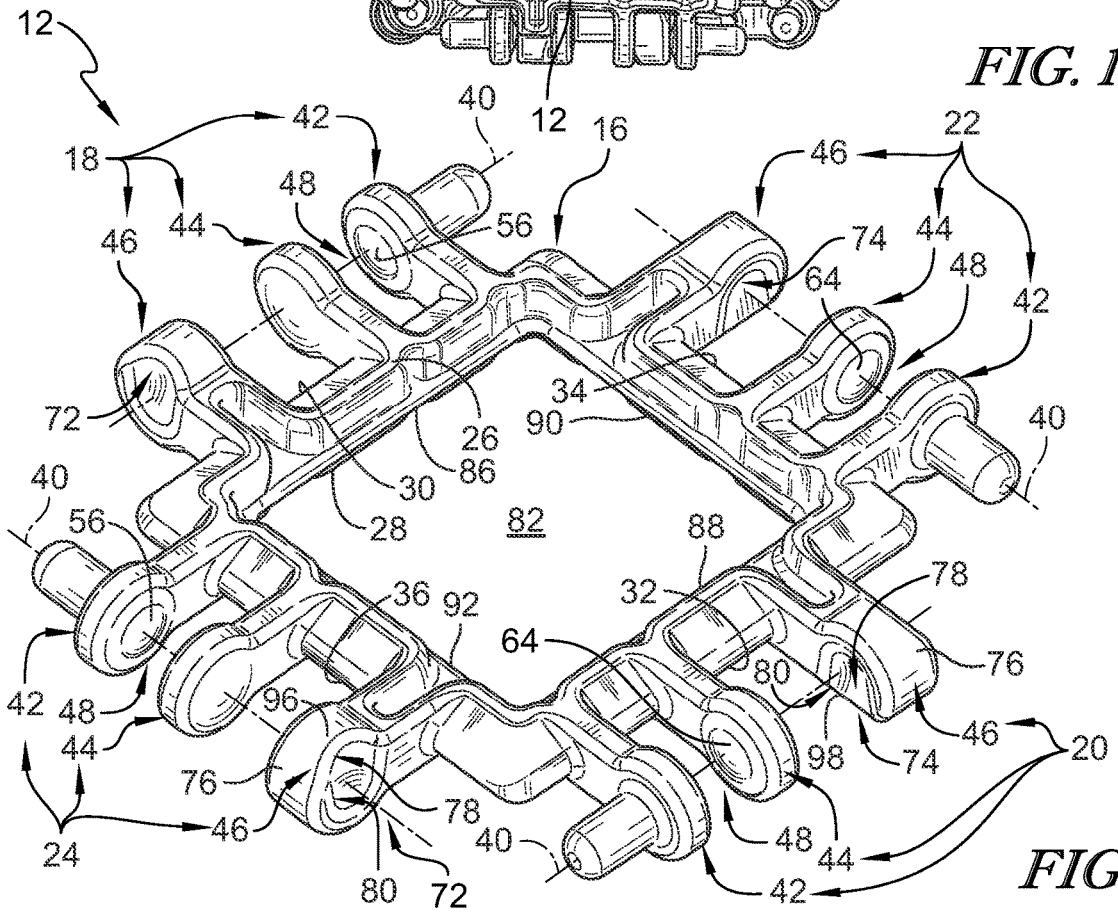
FIG. 2 is a perspective view of one interlocking piece of the plurality of interlocking pieces of FIG. 1 showing each square interlocking piece includes a planar body with a plurality of lateral edges that form a square shape and a plurality of interlocking flanges that extend away from each lateral edge of the plurality of lateral edges to interlock with corresponding interlocking flanges formed on a lateral edge of an adjacent interlocking piece and provide a snap-hinge connection.

The first and second depressions 72, 74 each include a first portion 78 and a second portion 80 as shown in FIG. 2. The first portion 78 is located on the interlock pivot axis 40. The second portion 80 extends from the first portion 78 to an edge 96 or an edge 98 of the third interlocking flange 46. The second portion 80 of the first depression 72 extends from the first portion 78 to the edge 96, while the second portion 80 of the second depression 74 extends from the first portion 78 to the edge 98.

In the illustrative embodiment, the second portion 80 of the first depression 72 extends to an upper edge 96 of the third interlocking flange 46. The second portion 80 of the second depression 74 extends in the opposite direction to a lower edge 98 of the third interlocking flange 46.

In the illustrative embodiment, when the third interlocking flange 46 is located in the slot 48', the first depression 72 engages with the first domed protrusion 56' of the first interlocking flange 42' and the second depression 74 engages with the second domed protrusion 64' of the second interlocking flange 44'.

In the illustrative embodiments, the terminal ends 58, 66, 76 of the interlocking flanges 42, 44, 46 are rounded as shown in FIGS. 2-7. Each of the interlocking flange 42, 44, 46 has a length $L_1$, $L_2$, $L_3$ defined by the lateral edge 30, 32, 34, 36 and the terminal end 58, 66, 76 of the interlocking flange 42, 44, 46. The lengths $L_1$, $L_2$, $L_3$ of each of the flanges 42, 44, 46 are equal.

In the illustrative embodiments, the first and second interlocking flanges 42, 44 are spaced axially apart relative to the interlock pivot axis 40 a first distance $d_1$. The third interlocking flange 46 is spaced apart from the second interlocking flange a second distance $d_2$. The second distance $d_2$ is greater than the first distance $d_1$ so that there is a space 41 between the second flange 44 of one interlocking piece 12 and the second flange 44' of the adjacent interlocking piece 12' when engaged in the snap-hinge connection 38. The space 41 prevents interference between the second flanges 44, 44' of the adjacent interlocking pieces 12, 12' that would otherwise block rotation of the pieces 12, 12' relative to each other.

Turning again to the planar body 16 of the square interlocking pieces 12, the planar body 16 is shaped to include a hole 82 as shown in FIG. 2. The hole 82 that extends through the planar body 16 from the top side 26 to the bottom side 28 at a center of the planar body 16.

In the illustrative embodiment, the hole 82 is shaped to include a plurality of lateral inner edges 86, 88, 90, 92 as shown in FIG. 2. The number of inner edges 86, 88, 90, 92 is equal to the number of lateral edges 30, 32, 34, 35 of the planar body 16. In other embodiments, the hole 82 may be shaped to include a plurality of lateral inner edges 86, 88, 90, 92 that is less than or greater than the number of lateral edges 30, 32, 34, 36 included in the plurality of lateral edges 30, 32, 34, 36 of the planar body 16.

The hole 82 may be shaped to include a plurality of lateral inner edges 86', 88', 90' that is less than the number of lateral edges 30, 32, 34, 36 included in the plurality of lateral edges 30, 32, 34, 36 of the planar body 16 as shown in FIG. 3. The hole 82 may be shaped to include a plurality of lateral inner edges 86", 88", 90", 92", 93" that is less greater than the number of lateral edges 30, 32, 34, 36 included in the plurality of lateral edges 30, 32, 34, 36 of the planar body 16 as shown in FIG. 3.

A method of assembling two interlocking pieces 12, 12' together includes inserting the third interlocking flange 46 of one piece 12 into the slot 48' of the adjacent piece 12', while simultaneously inserting the third interlocking flange 46' of the adjacent piece 12' into the slot 48 of the other piece 12. To insert the third interlocking flanges 46, 46' into the respective slots 48, 48', the two pieces 12, 12' are aligned so that the corresponding lateral edge 30, 32, 34, 36 of one piece 12 is parallel to the corresponding lateral edge 30' 32' 34', 36' of the adjacent piece 12' to be interlocked with the one piece 12. The pieces 12, 12' are also aligned so that the third interlocking flange 46 of one piece 12 is lines up with the slot 48' of the adjacent piece 12', while the third interlocking flange 46' of the adjacent piece 12' lines up with the slot 48 of the other piece 12.

To aid in aligning the pieces 12, 12', the knobs 54, 54' of each piece 12, 12' may be oriented so that the knob 54' of the adjacent piece 12' extends in the opposite direction of the knob 54 of the other piece 12. In doing so, the slots 48, 48' and third interlocking flanges 46, 46' will be orientated in the correct position to be inserted into one another.

To ensure the snap-hinge connection 38 is engaged, the interlocking flanges 46, 46' are inserted in the corresponding slots 48, 48' until the concave depressions 72, 74 of the third interlocking flange 46 of one piece 12 are engaged in the protrusions 56', 64' of the first and second interlocking flanges 42', 44' of the adjacent piece 12'. Similarly, the concave depressions 72', 74' of the third interlocking flange 46' of the adjacent piece 12' are engaged in the protrusions 56, 64 of the first and second interlocking flanges 42, 44 of the other piece 12.

Once the snap-hinge connection 38 is engaged, the pieces 12, 12' may be rotated relative to one another as illustrated in FIG. 7. The piece 12 may be rotated until the desired angle between the two pieces 12, 12' is achieved.

Additionally, another piece 12' may be coupled to any of the other remaining plurality of interlocking flanges 18, 22, 24 of the interlocking piece 12. Or, another piece 12 may be coupled to any of the other remaining plurality of interlocking flanges 20', 22', 24' of the adjacent piece 12'. The previous steps may be repeated to interlock additional pieces 12 to the other remaining lateral sides 30, 34, 36 of the piece 12 and/or the other remaining lateral sides 32' 34' 36 of the adjacent piece 12'.

Turning again to the triangular interlocking pieces 14, each of the triangular interlocking pieces 14 included in the plurality of interlocking pieces 12 and 14 includes a planar body 17 and a plurality of interlocking flanges 19, 21, 23 as shown in FIGS. 1, and 8-10. The planar body 17 has a top side 27, a bottom side 29 opposite the top side 27, and a plurality of lateral edges 31, 33, 35. The plurality of lateral edges 31, 33, 35 extend between and interconnect the top and bottom sides 27, 29. The planar body 17 includes three lateral edges 31, 33, 35 in the illustrative embodiment.

The plurality of interlocking flanges 19, 21, 23 are identical to the interlocking flanges 18, 20, 22, 24 of the square interlocking pieces 12. The plurality of interlocking flanges 19, 21, 23 extend away from each lateral edge 31, 33, 35 of the plurality of lateral edges 31, 33, 35 and are configured to interlock with corresponding interlocking flanges 18, 20, 22, 24 formed on a lateral edge 30, 32, 34, 36 of an adjacent interlocking piece 12. The plurality of interlocking flanges 19, 21, 23 are also configured to interlock with corresponding interlocking flanges 19, 21, 23 of an adjacent triangular interlocking piece 14 or interlocking piece with a different geometric pattern such as interlocking piece 12 which has a square pattern.

Figure 10:
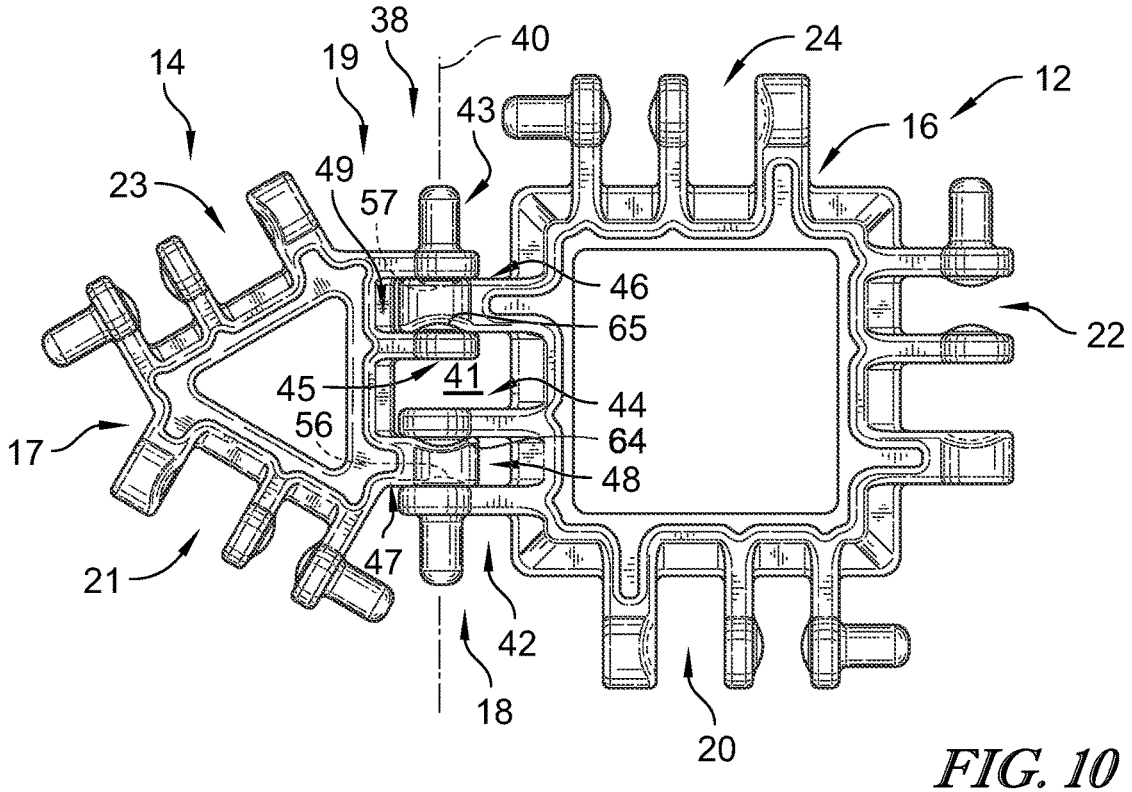
FIG. 10 is a view similar to FIG. 9 showing the adjacent interlocking pieces with the interlocking flanges engaged in the snap-hinge connection.
Figure 11:
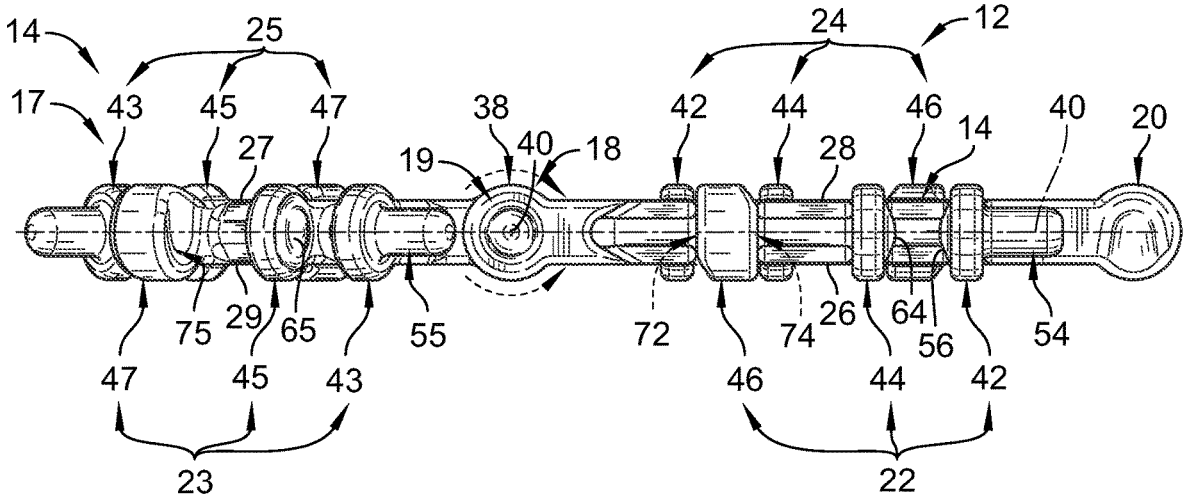
FIG. 11 is an elevation view of the adjacent interlocking pieces of FIG. 10 showing the adjacent interlocking pieces with the interlocking flanges engaged in the snap-hinge connection.
Figure 12:
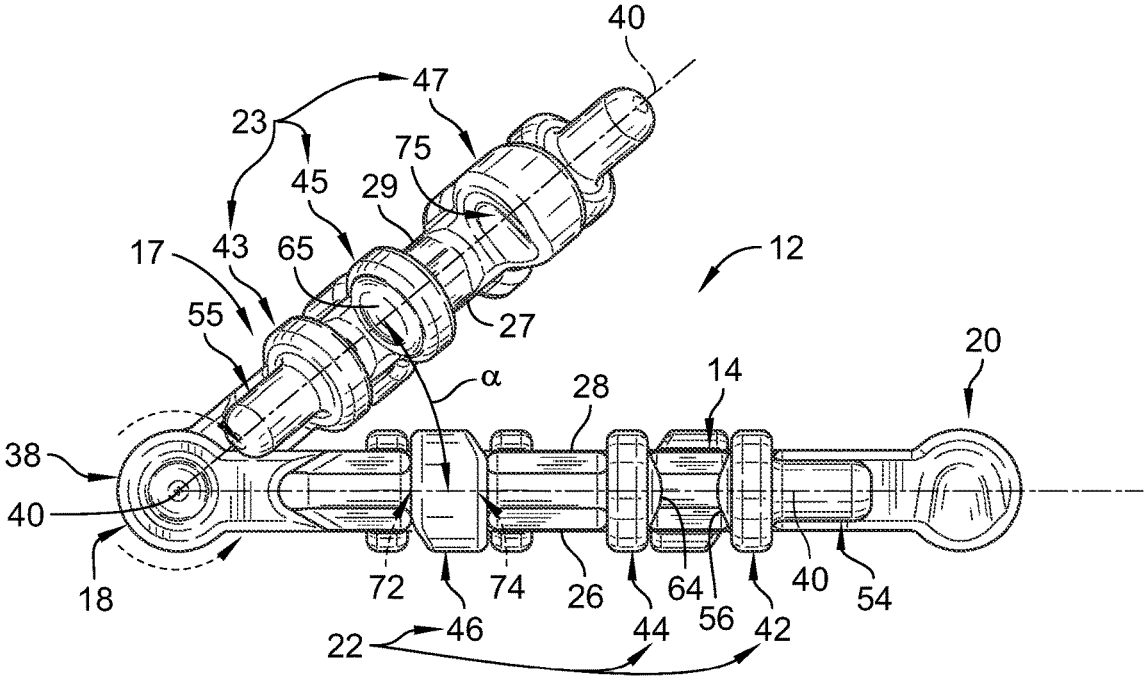
FIG. 12 is a view similar to FIG. 11 showing the adjacent pieces may form acute angles therebetween.

The plurality of interlocking flanges 18, 19, 20, 21, 22, 23, 24 of adjacent interlocking pieces 12, 14 interlock together to provide the snap-hinge connection 38 as shown in FIG. 10. The interlocking flanges 19, 21, 23 of adjacent interlocking pieces 14 also interlock together to provide the snap-hinge connection. The snap-hinge connection 38 couples the adjacent interlocking pieces 12, 14 together and allows the adjacent interlocking pieces 12, 14 to rotate relative to each other about an interlock pivot axis 40. The interlock pivot axis 40 is parallel to the lateral edges 30, 31, 32, 33, 34, 35, 36 of the adjacent interlocking pieces 12, 14.

The plurality of lateral edges 31, 33, 35 includes at three lateral edges 31, 33, 35 of equal length in the illustrative embodiment. The plurality of interlocking flanges 19 extends from the first lateral edge 31. The plurality of interlocking flanges 21 extends from the second lateral edge 33. The plurality of interlocking flanges 23 extends form the third lateral edge 35.

Figure 8:
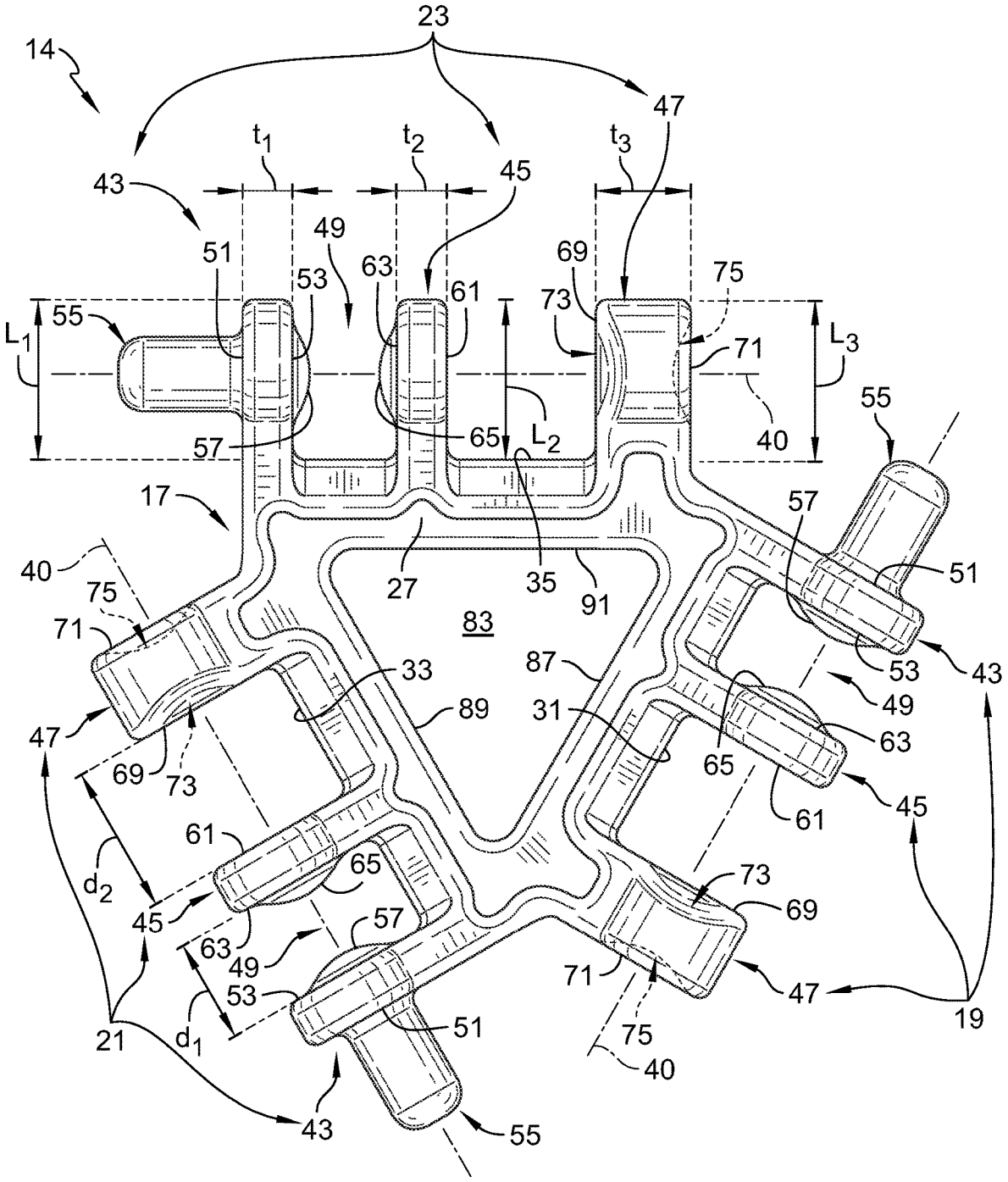
FIG. 8 is a perspective view of one interlocking piece of the plurality of interlocking pieces of FIG. 1 showing each triangular interlocking piece includes a planar body with a plurality of lateral edges that form a triangular shape and a plurality of interlocking flanges that extend away from each lateral edge of the plurality of lateral edges to interlock with corresponding interlocking flanges formed on a lateral edge of an adjacent interlocking piece and provide a snap-hinge connection.
Figure 9:
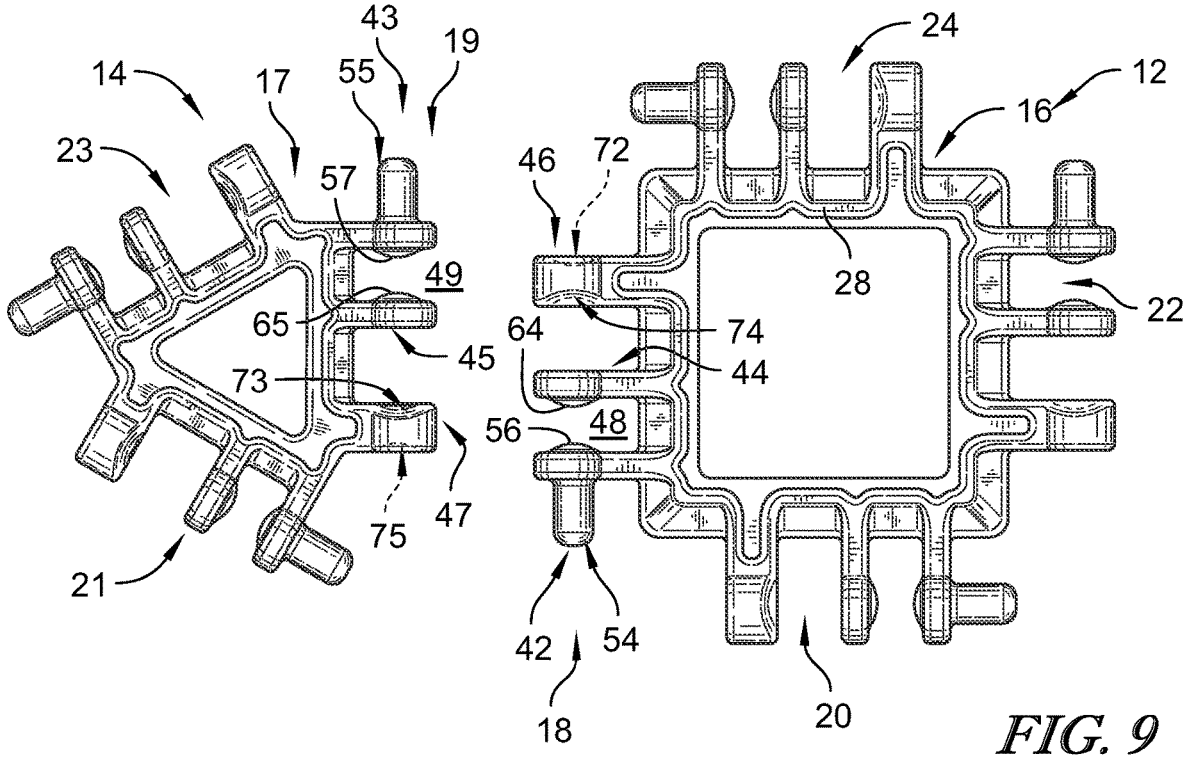
FIG. 9 is an elevation view of the interlocking piece of FIG. 8 adjacent to one square interlocking piece showing the plurality of interlocking flanges of the triangular interlocking piece include a first interlocking flange, a second interlocking flange, and a third interlocking flange that are configured to interlock with the plurality of interlocking flanges on the square interlocking piece to provide the snap-hinge connection.

In the illustrative embodiment, the plurality of interlocking flanges 19, 21, 23 on each lateral edge 31, 33, 35 of the planar body 17 includes a first interlocking flange 43, a second interlocking flange 45, and a third interlocking flange 47 as shown in FIGS. 8-10. The second interlocking flange 45 is spaced apart axially from the first interlocking flange 43 relative to the interlock pivot axis 40 to define a slot 49 therebetween. The third interlocking flange 47 is spaced apart axially from the second interlocking flange 45 relative to the interlock pivot axis 40.

The third interlocking flange 47 is configured to extend into the slot 48 formed between the first and second interlock flanges 42, 44 on the adjacent interlocking piece 12 as shown in FIGS. 9 and 10. The third interlocking flange 47 engages the first and second interlock flanges 42, 44 to provide the snap-hinge connection 38 therebetween.

The third interlocking flange 47 is also configured to extend into the slot 49 formed between the first and second interlock flanges 43, 45 on an adjacent interlocking piece 14. The third interlocking flange 47 engages the first and second interlock flanges 43, 45 to provide the snap-hinge connection 38 therebetween.

Each of the first interlocking flanges 43 and the second interlocking flanges 45 are shaped to include a domed protrusion 57, 65 as shown in FIGS. 8-10. The first domed protrusion 57 on the first interlocking flange 43 extends away from the first interlocking flange 43 into the slot 49, while the second domed protrusion 65 on the second interlocking flange 45 extends away from the second interlocking flange 45 into the slot 49. The first and second domed protrusions 57, 65 are configured to engage the third interlocking flange 46 of the adjacent interlocking piece 12 to provide the snap-hinge connection 38 therebetween. The first and second domed protrusions 57, 65 are also configured to engage the third interlocking flange 47 of the adjacent interlocking piece 14 to provide the snap-hinge connection 38 therebetween.

The first interlocking flange 43 comprises a first side surface 51, a second side surface 53, a knob 55, and the first domed protrusion 57 as shown in FIG. 8. The first and second side surfaces 51, 53 extend away from the corresponding lateral edge 31, 33, 35. The first interlocking flange 43 has the same thickness $t_1$ as the first interlocking flange. The knob 55 extends from the first side surface 51 along the interlock pivot axis 40. The second side surface 53 faces the slot 49 such that the first domed protrusion 57 extends from the second side surface 53 into the slot 49.

In the illustrative embodiment, the second interlocking flange 45 comprises a first side surface 61, a second side surface 63, and the second domed protrusion 65 as shown in FIG. 8. The first and second side surfaces 61, 63 extend away from the corresponding lateral edge 31, 33, 35. The second interlocking flange has the same thickness $t_2$ as the second interlocking flange 44. The second side surface 63 faces the slot 49 such that the second domed protrusion 65 extends from the second side surface 63 into the slot 49.

Each third interlocking flange 47 comprises a first side surface 69, a second side surface 71, and depressions 73, 75 as shown in FIG. 8. The first and second side surfaces 69, 71 extend away from the corresponding lateral edge 31, 33, 35. The third interlocking flange 47 has the same thickness t3 as the third interlocking flange 46. The first depression 73 extends into the first side surface 69, while the second depression 75 extends into the second side surface 71.

The first and second depressions 73, 75 are configured to engage corresponding domed protrusions 56, 64 of the adjacent interlocking piece 12 to provide the snap-hinge connection 38 therebetween. The first and second depressions 73, 75 are also configured to engage the corresponding domed protrusions 57, 65 of the adjacent interlocking piece 14 to provide the snap-hinge connection 38 therebetween.

In the illustrative embodiment, when the third interlocking flange 47 is located in the slot 48, the first depression 73 engages with the first domed protrusion 56 of the first interlocking flange 42 and the second depression 75 engages with the second domed protrusion 64. When interlocking two triangular pieces 14, the third interlocking flange 47 is located in the slot 49 so that the first depression 73 engages with the first domed protrusion 57 of the first interlocking flange 43 and the second depression 75 engages with the second domed protrusion 65.

Each of the interlocking flange 43, 45, 47 has a length that are equal to the lengths $L_1$, $L_2$, $L_3$ of the interlocking flanges 42, 44, 46. The lengths $L_1$, $L_2$, $L_3$ of each of the flanges 42, 44, 46 are equal.

In the illustrative embodiments, the first and second interlocking flanges 43, 45 are spaced axially apart relative to the interlock pivot axis 40 a distance that is equal to the distance $d_1$. The third interlocking flange 46 is spaced apart from the second interlocking flange a distance that is equal to the distance $d_2$.

Turning again to the planar body 17 of the triangular interlocking piece 14, the planar body 17 is shaped to include a hole (or space) 83 as shown in FIG. 8. The hole 83 that extends through the planar body 17 from the top side 27 to the bottom side 29 of the planar body 17.

In the illustrative embodiment, the hole 83 is shaped to include a plurality of lateral inner edges 87, 89, 91 as shown in FIG. 8. The number of inner edges 87, 89, 91 is equal to the number of lateral edges 31, 33, 35 of the planar body 17. In other embodiments, the hole 83 may be shaped to include a plurality of lateral inner edges 87, 89, 91 that is less than or greater than the number of lateral edges 31, 33, 35 included in the plurality of lateral edges 31, 33, 35 of the planar body 17.

A method of assembling two interlocking pieces 12, 14 together includes inserting the third interlocking flange 46 of one piece 12 into the slot 49 of the adjacent piece 14, while simultaneously inserting the third interlocking flange 47 of the adjacent piece 14 into the slot 48 of the other piece 12. To insert the third interlocking flanges 46, 47 into the respective slots 48, 49, the two pieces 12, 14 are aligned so that the corresponding lateral edge 30, 32, 34, 36 of one piece 12 is parallel to the corresponding lateral edge 31, 33, 35 of the adjacent piece 14 to be interlocked with the one piece 12. The pieces 12, 14 are also aligned so that the third interlocking flange 46 of one piece 12 is lines up with the slot 49 of the adjacent piece 14, while the third interlocking flange 47 of the adjacent piece 14 lines up with the slot 48 of the other piece 12.

To aid in aligning the pieces 12, 14, the knobs 54, 55 of each piece 12, 14 may be oriented so that the knob 55 of the adjacent piece 14 extends in the opposite direction of the knob 54 of the other piece 12. In doing so, the slots 48, 49 and third interlocking flanges 46, 47 will be orientated in the correction position to be inserted into one another.

To ensure the snap-hinge connection 38 is engaged, the interlocking flanges 46, 47 are inserted in the corresponding slots 48, 49 until the depressions 72, 74 of the third interlocking flange 46 of one piece 12 are engaged in the protrusions 57, 65 of the first and second interlocking flanges 43, 45 of the adjacent piece 14. Similarly, the depressions 73, 75 of the third interlocking flange 47 of the adjacent piece 14 are engaged in the protrusions 56, 64 of the first and second interlocking flanges 42, 44 of the other piece 12.

Once the snap-hinge connection 38 is engaged, the pieces 12, 14 may be rotated relative to one another as suggested by FIG. 10. The piece 14 may be rotated until the desired angle between the two pieces 12, 14 is achieved. Conversely, the piece 12 may be rotated until the desired angle between the two pieces 12, 14 is achieved.

Additionally, another piece 12, 14 may be coupled to any of the other remaining plurality of interlocking flanges 18, 22, 24 of the interlocking piece 12. Or, another piece 12, 14 may be coupled to any of the other remaining plurality of interlocking flanges 21, 23 of the adjacent piece 14. The previous steps may be repeated to interlock additional pieces 12, 14 to the other remaining lateral sides 30, 34, 36 of the piece 12 and/or the other remaining lateral sides 33, 35 of the adjacent piece 14.

Additionally, two triangular interlocking pieces 14 may be interlocked together by inserting the third interlocking flange 47 of one piece 14 into the slot 49 of the adjacent piece 14, while simultaneously inserting the third interlocking flange 47 of the adjacent piece 14 into the slot 49 of the other piece 12. To insert the third interlocking flanges 47 into the respective slots 49, the two pieces 14 are aligned so that the corresponding lateral edge 31, 33, 35 of one piece 14 is parallel to the corresponding lateral edge 31, 33, 35 of the adjacent piece 14 to be interlocked with the one piece 14. The pieces 14 are also aligned so that the third interlocking flange 47 of one piece 14 is lines up with the slot 49 of the adjacent piece 14, while the third interlocking flange 47 of the adjacent piece 14 lines up with the slot 49 of the other piece 14.

To aid in aligning the pieces 14, the knobs 55 of each piece 14 may be oriented so that the knob 55 of the adjacent piece 14 extends in the opposite direction of the knob 55 of the other piece 14. In doing so, the slots 49 and third interlocking flanges 47 will be orientated in the correction position to be inserted into one another.

Once the snap-hinge connection 38 is engaged, the pieces 14 may be rotated relative to one another. The piece 14 may be rotated until the desired angle between the two pieces 14 is achieved.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An interlocking toy set comprising a plurality of interlocking pieces, the plurality of interlocking pieces comprising:

a planar body including a top side, a bottom side opposite the top side, and a plurality of lateral edges that extend between and interconnect the top and bottom sides;

a plurality of interlocking flanges that extend away from each edge of the plurality of lateral edges and configured to interlock with corresponding interlocking flanges formed on a lateral edge of an adjacent interlocking piece of the plurality of interlocking pieces to provide a snap-hinge connection that couples adjacent interlocking pieces together and allows the adjacent interlocking pieces to rotate relative to each other about an interlock pivot axis that is parallel to the lateral edge of the adjacent interlocking piece, the plurality of interlocking flanges including a first interlocking flange shaped to include a first domed protrusion that axially extends away from the first interlocking flange and a knob that axially extends away from the first interlocking flange opposite the first domed protrusion, a second interlocking flange spaced apart axially from the first interlocking flange relative to the interlock pivot axis to define a slot therebetween, the second interlocking flange shaped to include a second domed protrusion that axially extends away from the second interlocking flange, and a third interlocking flange spaced apart axially from the second interlocking flange relative to the interlock pivot axis and configured to extend into the slot formed between the first and second interlock flanges on the adjacent interlocking piece and engage the first domed protrusion and the second domed protrusion to provide the snap-hinge connection therebetween, wherein the snap-hinge connection is configured to allow the adjacent interlocking pieces to form an acute angle between the planar body of one interlocking piece and the planar body of the adjacent interlocking piece.

2. The interlocking toy set of claim 1, wherein the acute angle may be 30 degrees.

3. The interlocking toy set of claim 2, wherein the plurality of lateral edges include at least three lateral edges.

4. The interlocking toy set of claim 3, wherein the plurality of lateral edges include at least four lateral edges.

5. The interlocking toy set of claim 4, wherein the plurality of lateral edges include more than four lateral edges.

6. The interlocking toy set of claim 1, wherein the first interlocking flange has a first thickness equal to a second thickness of the second interlocking flange and less than a third thickness of the third interlocking flange.

7. The interlocking toy set of claim 1, wherein each third interlocking flange comprises:

a first side surface, a second side surface spaced axially apart from the first side surface to define a thickness of the third interlocking flange, a first depression that extends into the first side surface, and a second depression that extends into the second side surface, the first and second depressions configured to engage corresponding domed protrusions of the adjacent interlocking piece to provide the snap-hinge connection therebetween.

8. The interlocking toy set of claim 7, wherein the first and second depressions include a first portion located on the interlock pivot axis and a second portion that extends from the first portion to an edge of the third interlocking flange.

9. The interlocking toy set of claim 7, wherein the knob is configured to provide assistance in disassembling the adjacent interlocking pieces.

10. The interlocking toy set of claim 1, wherein the planar body is shaped to include a hole that extends through the planar body from the top side to the bottom side at a center of the planar body.

11. The interlocking toy set of claim 10, wherein the hole is shaped to include a plurality of lateral inner edges that is equal to the plurality of lateral edges of the planar body.

12. The interlocking toy set of claim 10, wherein the hole is shaped to include a plurality of lateral inner edges that is less than or greater than a number of lateral edges included in the plurality of lateral edges of the planar body.

13. An interlocking toy set comprising a plurality of interlocking pieces, the plurality of interlocking pieces comprising:

a planar body including a plurality of lateral edges of equal length that are shaped to form a polygonal shape of the planar body, and a plurality of interlocking flanges that extend away from each lateral edge of the plurality of lateral edges and configured to interlock with corresponding interlocking flanges formed on a lateral edge of an adjacent interlocking piece of the plurality of interlocking pieces to provide a snap-hinge connection that couples adjacent interlocking pieces together and allows the adjacent interlocking pieces to rotate relative to each other about an interlock pivot axis that is parallel to the lateral edge of the adjacent interlocking piece, the plurality of interlocking flanges including a first interlocking flange shaped to include a first domed protrusion that axially extends away from the first interlocking flange, a second interlocking flange spaced apart axially from the first interlocking flange relative to the interlock pivot axis to define a slot therebetween, the second interlocking flange shaped to include a second domed protrusion that axially extends away from the second interlocking flange, and a third interlocking flange spaced apart axially from the second interlocking flange relative to the interlock pivot axis and configured to extend into the slot formed between the first and second interlock flanges on the adjacent interlocking piece and engage the first and second domed protrusions to provide the snap-hinge connection therebetween, wherein the first interlocking flange is shaped to include a knob that axially extends away from the first interlocking flange opposite the domed projection included in the first interlocking flange.

14. The interlocking toy set of claim 13, wherein the snap-hinge connection is configured to allow the adjacent interlocking pieces to form an acute angle therebetween.

15. The interlocking toy set of claim 14, wherein the acute angle is 30 degrees.

16. The interlocking toy set of claim 13, wherein the plurality of lateral edges include at least three lateral edges.

17. The interlocking toy set of claim 13, wherein the first interlocking flange has a first thickness equal to a second thickness of the second interlocking flange and less than a third thickness of the third interlocking flange.

18. The interlocking toy set of claim 13, wherein each third interlocking flange comprises:

a first side surface, a second side surface spaced axially apart from the first side surface to define a thickness of the third interlocking flange, a first depression that extends into the first side surface, and a second depression that extends into the second side surface, the first and second depressions configured to engage corresponding domed protrusions of the adjacent interlocking piece to provide the snap-hinge connection therebetween.

19. The interlocking toy set of claim 13, wherein the planar body is shaped to include a hole that extends through the planar body at a center of the planar body.

* * * * *